US012252956B2

(12) United States Patent
Rejepov et al.

(10) Patent No.: US 12,252,956 B2
(45) Date of Patent: Mar. 18, 2025

(54) SYSTEM AND METHODS FOR A QUICK RELEASE COLLAR IN CEMENTING CASING STRINGS

(71) Applicant: SAUDI ARABIAN OIL COMPANY, Dhahran (SA)

(72) Inventors: Dautmammet Rejepov, Abqaiq (SA); Syed Muhammad Ali, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 51 days.

(21) Appl. No.: 18/305,803

(22) Filed: Apr. 24, 2023

(65) Prior Publication Data

US 2024/0352824 A1 Oct. 24, 2024

(51) Int. Cl.

| | |
|---|---|
| ***E21B 33/14*** | (2006.01) |
| ***E21B 17/046*** | (2006.01) |
| ***E21B 17/06*** | (2006.01) |
| ***E21B 33/04*** | (2006.01) |

(52) U.S. Cl.

CPC ..... *E21B 33/14* (2013.01); *E21B 17/046* (2013.01); *E21B 17/06* (2013.01); *E21B 33/04* (2013.01)

(58) Field of Classification Search

CPC ..... E21B 17/043; E21B 17/046; E21B 17/06; E21B 17/0853; E21B 23/02; E21B 33/04; E21B 33/14; E21B 33/146; E21B 43/10

See application file for complete search history.

(56) References Cited

U.S. PATENT DOCUMENTS

| | | | | | |
|---|---|---|---|---|---|
| 1,610,414 | A | * | 12/1926 | Bernard | F16D 9/06 464/33 |
| 1,923,132 | A | * | 8/1933 | Witkin | E21B 17/06 464/33 |
| 3,347,319 | A | | 10/1967 | Littlejohn | |
| RE29,830 | E | * | 11/1978 | Scott | E21B 33/076 166/155 |
| 4,291,767 | A | * | 9/1981 | Hall, Jr. | E21B 33/14 166/93.1 |
| 4,770,249 | A | * | 9/1988 | Courtney | E21B 33/03 166/380 |

(Continued)

FOREIGN PATENT DOCUMENTS

| | | | | | |
|---|---|---|---|---|---|
| CN | 2176427 | Y | * | 9/1994 | E21B 33/04 |
| RU | 2769020 | C1 | * | 3/2022 | |
| WO | WO-2004072434 | A2 | * | 8/2004 | E21B 17/07 |

OTHER PUBLICATIONS

Slb, "Conductor Pipe", downloaded Aug. 8, 2024, https://glossary.slb.com/en/terms/c/conductor_pipe, 2 pages (Year: 2024).*

*Primary Examiner* — Jennifer H Gay

(74) *Attorney, Agent, or Firm* — Osha Bergman Watanabe & Burton LLP

(57) ABSTRACT

A system includes a first tubular string within a wellbore and a collar coupled to a top of the first tubular string. The collar may include a body extending from a first end to a second end. The body includes an internal ring extending radially inward from an inner surface of the body. The internal ring includes at least two holes extending through a top surface of the internal ring to a bottom surface internal. Additionally, a second tubular string within the wellbore extends through the first tubular string. An outer ring of the second tubular string lands on the internal ring.

17 Claims, 9 Drawing Sheets

(56) References Cited

U.S. PATENT DOCUMENTS 5,086,843 A * 2/1992 Mims ..... E21B 43/10 175/320
6,095,243 A * 8/2000 Van Bilderbeek ..... E21B 33/14 166/88.1
6,962,205 B1 * 11/2005 Lay, Jr. ..... E21B 33/038 166/85.1
7,730,965 B2 6/2010 Jordan et al.
7,926,590 B2 4/2011 Eriksen et al.
8,919,453 B2 * 12/2014 He ..... E21B 33/13 166/382
8,955,594 B2 * 2/2015 Bell ..... E21B 33/035 166/341
9,482,061 B2 * 11/2016 Latimer ..... E21B 17/085
9,605,492 B2 * 3/2017 Dietz ..... E21B 17/043
9,605,503 B2 * 3/2017 Boisvert ..... E21B 43/10
10,041,308 B2 * 8/2018 Bowley ..... F16L 15/001
10,307,900 B1 * 6/2019 Harris ..... B25B 27/0021
10,526,860 B2 * 1/2020 Rose ..... E21B 19/02
10,570,688 B2 * 2/2020 Rose ..... E21B 33/04
2013/0092397 A1 * 4/2013 He ..... E21B 33/03 166/208
2013/0126181 A1 * 5/2013 Bell ..... E21B 33/035 166/360
2014/0305659 A1 * 10/2014 Boisvert ..... E21B 43/10 166/380
2014/0311753 A1 * 10/2014 Hanson ..... E21B 33/14 166/208
2015/0260002 A1 * 9/2015 Nguyen ..... E21B 43/10 166/382
2015/0337607 A1 * 11/2015 Latimer ..... E21B 19/004 166/345
2016/0084016 A1 * 3/2016 Slaughter, Jr. ..... E21B 17/03 403/376
2016/0222747 A1 * 8/2016 Rose ..... E21B 43/10
2016/0222768 A1 * 8/2016 Rose ..... E21B 33/04
2016/0230478 A1 * 8/2016 Dietz ..... E21B 17/06
2017/0167203 A1 * 6/2017 Bowley ..... F16L 15/001
2017/0335657 A1 * 11/2017 Abney ..... E21B 34/103
2019/0186240 A1 * 6/2019 Fitzhugh ..... E21B 23/01
2020/0208487 A1 * 7/2020 Rose ..... E21B 33/04

* cited by examiner

SYSTEM AND METHODS FOR A QUICK RELEASE COLLAR IN CEMENTING CASING STRINGS

BACKGROUND

As illustrated in FIG. 1, a completed well 1 includes a casing profile 2 within a wellbore 3 extending from a surface 4 into subterranean formations 5. In general, there may be many layers of subterranean formations 5 below the surface 4. The casing profile 2 includes multiple casing strings, such as a conductor casing 6, a surface casing 7, an intermediate casing 8, and a production casing 9. The conductor casing 6 may be a large-diameter casing that protects shallow formations from contamination by drilling fluid and helps prevent washouts involving unconsolidated topsoils and sediments. The surface casing 7, the second string, has a smaller diameter than the conductor casing 6, maintains borehole integrity and prevents contamination of shallow groundwater by hydrocarbons, subterranean brines and drilling fluids. The intermediate casing 8, the third string, has a smaller diameter than the surface casing 7, isolates hydrocarbon-bearing, abnormally pressured, fractured and lost circulation zones, providing well control as engineers drill deeper. Multiple strings of the intermediate casing 8 may be required to reach the target producing zone. The production casing 9, or liner, is the last and smallest tubular element in the completed well 1. The production casing 9 isolates the zones above and within the production zone and withstands all of the anticipated loads throughout the well's life. Additionally, the production casing 9 may be perforated 10 to allow hydrocarbons to flow into the production casing 9.

Furthermore, each casing string 6-9 undergoes a cement operation. Typically, a well section is drilled; then a casing string (e.g., the conductor casing 6, the surface casing 7, the intermediate casing 8, or the production casing 9) is lowered into the wellbore 3 and then cemented with a cement slurry 11. The cement slurry 11 is a combination of cement, cement additives, and water. In FIGS. 2A-2C, a cement operation is illustrated. For example, a first casing string 13 (e.g., conductor string) is shown as cemented in with a first cement slurry 11*a*. With the first casing string 13 cemented, a new well section 12 is drilled. Once the new well section 12 has reached a required depth, a second casing string 14 is lowered and run through the new well section 12. Next, a second cement slurry 11*b* is pumped into the new well section 12 down through the second casing string 14 and into an annulus around the second casing string 14 or in the open hole below the second casing string 14.

In some embodiments, a diverter may be used at the surface to divert shallow water or hydrocarbon kicks while pumping in the second cement slurry 11*b* or kill fluids. With the second cement slurry 11*b* in place, operations are stopped for a predetermined time until the second cement slurry 11*b* hardens. Once the second cement slurry 11*b* cements the second casing string 14, a landing joint casing of the second casing string 14 is cut and welded to set the second casing string 14 within the new well section 12. However, when a diverter is used, the diverter must be lifted before the landing joint casing is cut. This increases potential hazards at the well site from lifting the diverter. Additionally, cutting and welding the landing joint casing also increases potential hazards at the well site.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a system that may include a first tubular string within a wellbore and a collar coupled to a top of the first tubular string. The collar may include a body extending from a first end to a second end. The body includes an internal ring extending radially inward from an inner surface of the body. The internal ring includes at least two holes extending through a top surface of the internal ring to a bottom surface internal. Additionally, a second tubular string within the wellbore extends through the first tubular string. An outer ring of the second tubular string lands on the internal ring.

In another aspect, this disclosure presents, in accordance with one or more embodiments, a method that may include lowering a first tubular string into a wellbore, a collar is coupled to a top end of the first tubular string; performing a first cementing by circulating a first cement slurry through a first float shoe at a bottom end of the first tubular string and into an annulus between the first tubular string and the wellbore; lowering a second tubular string into the wellbore; landing an outer ring of the second tubular string on an internal ring of the collar; and performing a second cementing by circulating a second cement slurry through a first float shoe at a bottom end of the first tubular string and into an annulus between the first tubular string and the wellbore.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
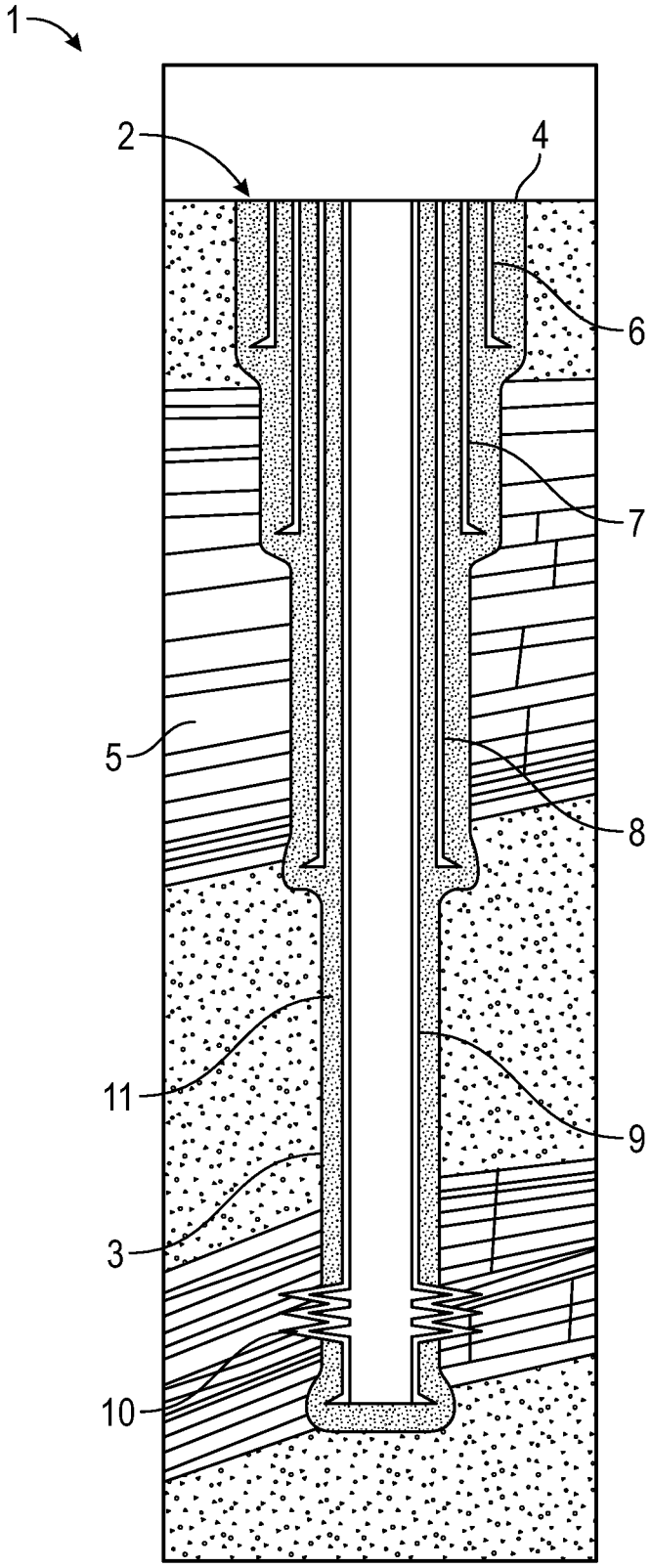
FIG. 1 (PRIOR ART)
FIGS. 1 and 2A-2C are schematic diagrams of a completion well system in accordance with prior art.
Figure 2A:
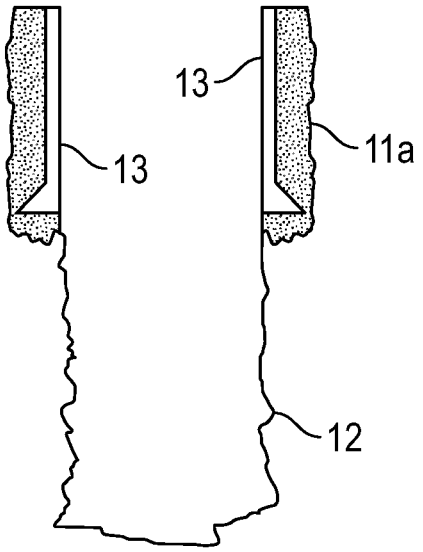
FIG. 2A (PRIOR ART)
Figure 2B:
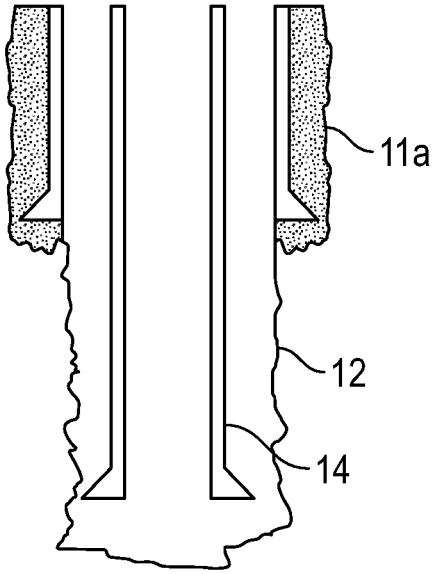
FIG. 2B (PRIOR ART)
Figure 2C:
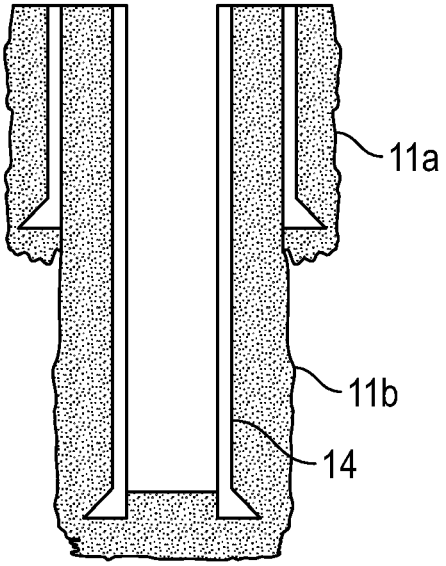
FIG. 2C (PRIOR ART)

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as land or sub-sea, without departing from the scope of the present disclosure. It is to be further understood that the various embodiments described herein may be used in various stages of a well (land and/or offshore), such as rig site preparation, drilling, completion, abandonment etc., and in other environments, such as work-over rigs, fracking installation, well-testing installation, oil and gas production installation, without departing from the scope of the present disclosure. The embodiments are described merely as examples of useful applications, which are not limited to any specific details of the embodiments herein.

Further, embodiments disclosed herein are described with terms designating in reference to a tubular, but any terms designating should not be deemed to limit the scope of the disclosure. For example, the tubular string is made up of numerous tubular pipes joined end-to-end, and each of the tubular pipes might be about twenty to forty feet in length. Further, the tubular pipes are hollow and thus provide a continuous channel of communication between the surface and the bottom of the wellbore, down through which a suitable fluid can be introduced to any region required within the well. It is to be further understood that the various embodiments described herein may be used with various types of tubulars, including but not limited to casing or liners, without departing from the scope of the present disclosure. A casing generally refers to a large-diameter pipe that is lowered into an openhole and cemented in place. As used herein, cement slurry may refer to a fluid made from a mixture of cement, cement additives and water.

In one or more embodiments, the present disclosure is directed to a quick release collar for installing a tubular string within a wellbore, either having tubulars or open hole. More specifically, embodiments disclosed herein are directed to a quick release collar coupled to a first tubular string such that a second tubular string is landed on the quick release collar. For example, the quick release collar includes an internal ring to receive an outer ring on the second tubular string. A locking mechanism may be used to lock the internal ring and the outer ring together. Further, both the internal ring and the outer ring include one or more ports to circulate fluids such as mud and a cement slurry. In some embodiments, a landing joint of the second tubular string may have a left-hand connection such that a left-hand turn can disconnect the landing joint from the second tubular string. Overall, the quick release collar as described herein may reduce product engineering, reduction of assembly time, hardware cost reduction, weight and envelope reduction, and reduction in operational costs associated with conventional cementing operations.

Figure 3:
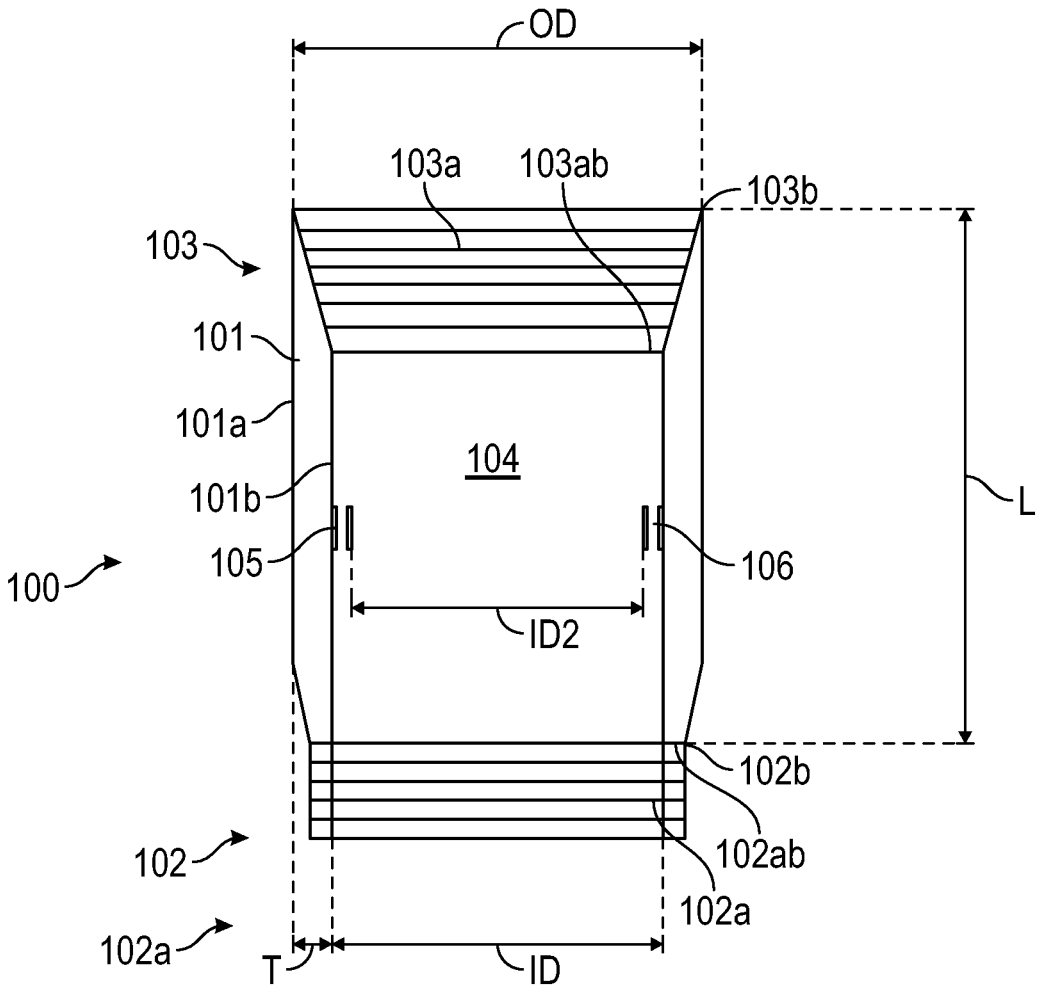
FIG. 3 illustrates a cross-sectional view of a quick release collar according to one or more embodiments of the present disclosure.

As shown in FIG. 3, in one or embodiments, a quick release collar 100 is defined by a body 101 extending from a first end 102 to a second end 103. Both the first end 102 and the second end 103 are connection ends to couple the quick release collar 100 to a tubular. For example, the first end 102 may be a threaded male connection 102*a* (e.g., pin end) and the second end 103 may be a threaded female connection 103*a* (e.g., box end) such that the quick release collar 100 may be threadly coupled to tubulars at both the first end 102 and the second end 103. The threaded male connection 102*a* and the threaded female connection 103*a* may have any type of threads to allow for a connection to the tubular string at any type of tubular string (e.g., the conductor casing, the surface casing, the intermediate casing, or the production casing). For example, the threaded male connection 102*a* may be coupled to the tubular string and the threaded female connection 103*a* may be coupled to a landing joint of the tubular string. Additionally, the quick release collar 100 may be above a cellar level of a wellbore. Further, a length L of the body 101 may be measured from a bottom shoulder 102*b* of the first end 102 to a top shoulder 103*b* of the second end 103. The length L may be 4 to 5 feet. It is further envisioned that the body 101 may have a same burst, collapse, and tri-axial rating as the tubular string at which the quick release collar 100 is installed.

In one or more embodiments, the body 101 includes an outer surface 101*a* and inner surface 101*b*. The outer surface 101*a* defines an outer diameter OD of the quick release collar 100 and the inner surface 101*b* defines a bore 104 having an inner diameter ID of the quick release collar 100. Fluids such as a cement slurry or mud is flown through the bore 104 and the outer surface 101*a* faces a wellbore. The difference between the outer diameter OD and the inner diameter ID is a thickness T of the quick release collar 100. The thickness T of the quick release collar 100 may be equal to or greater than a thickness of an adjacent tubular in the tubular string.

Still referring to FIG. 3, the quick release collar 100 includes an internal ring 105 extending radially inward from the inner surface 101*b* of the body 101. The internal ring 105 may be made of the same material (e.g., steel or metal alloys) as the body 101. For example, the internal ring 105 is integral to the body 101 such that the internal ring 105 may be machined during manufacturing. The internal ring 105 decreases the inner diameter ID of the body 101 to a second inner diameter ID2. The second inner diameter ID2 corresponds to a maximum outer diameter of tubulars and tools that may be run through the quick release collar 100. For example, the second inner diameter ID2 may be equal to or greater than an outer diameter of a tubular string running through and landing on the internal ring 105.

In some embodiments, the internal ring 105 may be positioned on the inner surface 101*b* a distance axially from the first end 102 and the second end 103 of the body 101. For example, the internal ring 105 may be spaced equally between a thread 102*ab* of the threaded male connection 102*a* closest to the bottom shoulder 102*b* and a thread 103*ab* of the threaded female connection 103*a* furthest to the top shoulder 103*b*. This positions the internal ring 105 in the middle of the quick release collar 100.

In one or more embodiments, the internal ring 105 includes at least two holes 106. One hole of the at least two holes 106 may be used to allow fluids, such as mud and cement slurry, to flow through the internal ring 105. Additionally, the other hole of the at least two holes 106 may be used to receive a locking mechanism to lock a tubular string extending through the quick release collar 100.

Figure 4:
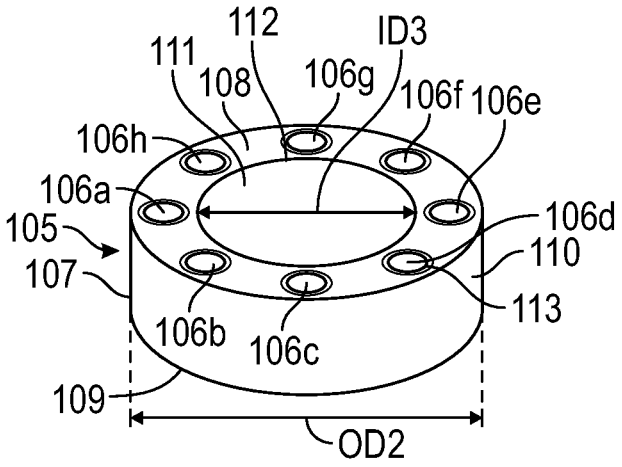
FIG. 4 illustrates a perspective view of an inner ring of the quick release collar of FIG. 3 according to one or more embodiments of the present disclosure.

Now referring to FIG. 4, a perspective view of the internal ring 105 is illustrated. The internal ring 105 is defined by a ring 107 extending from a top surface 108 to a bottom surface 109. Additionally, the ring 107 includes an outer surface 110 shaped and sized to be flush against the inner surface 101*b* of the quick release collar 100. For example, an outer diameter OD2 of the ring 107 is equal to the inner diameter (ID) of the body 101 of the quick release collar 100. Further, the ring 107 includes an annular bore 111 delimited by the ring 107. The annular bore 111 defines an inner diameter ID3 of the internal ring 105 which corresponds to the second inner diameter (ID2) of the quick release collar 100.

In one or more embodiments, the top surface 108 is a landing surface for an outer ring extending from a tubular string traveling through the quick release collar 100. For example, the top surface 108 may be flat and perpendicular to the inner surface 101*b* of the quick release collar 100 to allow flush engagement with the outer ring of the tubular string.

Still referring to FIG. 4, the internal ring 105 includes at least two holes 106*a*-106*h* extending through the ring 107 from the top surface 108 to the bottom surface 109. For example, eight holes 106*a*-106*h* may be circumferentially positioned between the annular bore 111 and the outer surface 110. Additionally, the eight holes 106*a*-106*h* may be evenly spaced from each other. For example, each hole 106*a*-106*h* may be radially spaced by 45 degrees in a circular pattern along the ring 107.

The holes 106*a*-106*h* are openings that extend axially through the ring 107. The holes 106*a*-106*h* allow fluid communication with an annulus formed by the inner surface 101*b* of the quick release collar 100 and the tubular string extending through the quick release collar 100. In some embodiments, at least four of the eight holes 106*a*-106*h* may be used to pump fluids (e.g., mud or cement slurry) in and out of the annulus while the other four of the eight holes 106*a*-106*h* may be used to receive corresponding locking mechanisms. It is further envisioned that the holes 106*a*-106*h* may have any shape (e.g., diamond, oval, circular, star, etc.) and size (i.e., diameter) delimited by a width of the ring 107 measured from the annular bore 111 to the outer surface 110.

In some embodiments, the top surface 108 may include one or more sealing elements 112-113. For example, a first sealing element 112 may be positioned on the top surface 108 circumferentially around the annular bore 111. A groove may be provided in the top surface 108 to receive the first sealing element 112. Additionally, a plurality of second sealing elements 113 may be positioned on the top surface 108 circumferentially around each hole 106*a*-106*h*. A corresponding groove around each hole 106*a*-106*h* may be provided in the top surface 108 to receive each of the second sealing elements 113. The first sealing element 112 and the plurality of second sealing elements 113 may be an elastomer ring or O-ring to prevent fluid leaks between internal ring 105 and the tubular string extending through the quick release collar (100).

Figure 5:
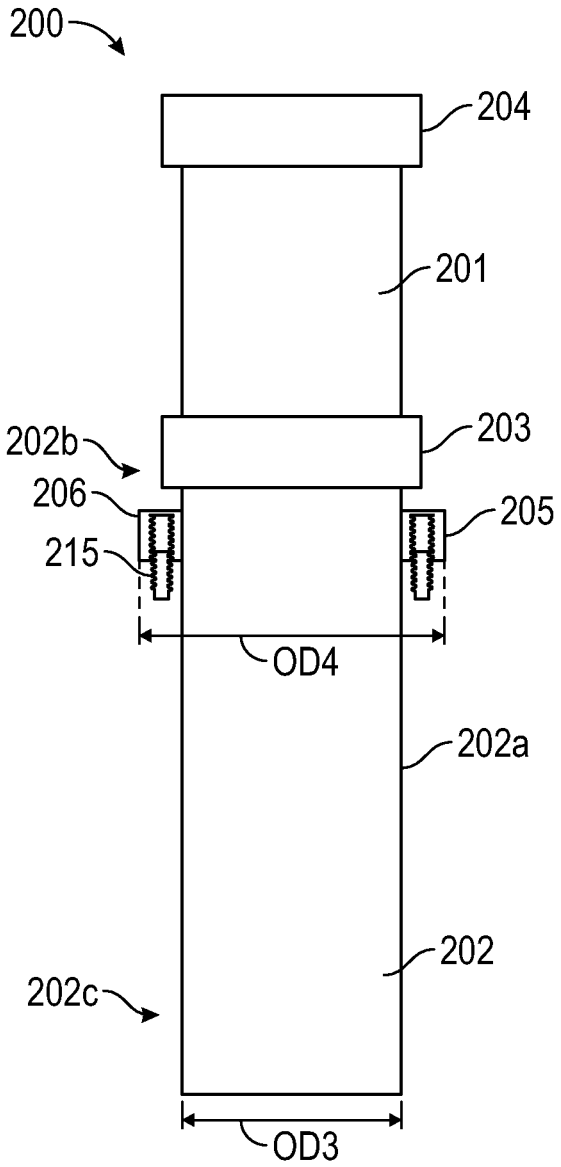
FIG. 5 illustrates a cross-sectional view of a tubular string according to one or more embodiments of the present disclosure.

Now referring to FIG. 5, a side view of a tubular string 200 is illustrated. One of ordinarily skill in the art would understand the tubular string 200 is made up of numerous tubular pipes joined end-to-end. As such, for simplicity purposes only, a landing joint 201 and a last tubular joint 202 of the tubular string 200 are only illustrated.

The landing joint 201 is a tubular joint that allows the lowering of the tubular string 200 into a wellhead to extend into the wellbore. For example, the landing joint 201 may have a first connection end 203 and a second connection end 204. The first connection end 203 may be coupled to the tubular string 200. The second connection end 204 may be coupled to surface equipment at a well site. In some embodiments, the second connection end 204 is a left-hand connection such that a left-hand turn can disconnect the landing joint 201 from the tubular string 200.

The last tubular joint 202 is a tubular joint last added to the tubular string 200. For example, the last tubular joint 202 is the upper most tubular joint in the tubular string 200 approximate the surface of the well.

In one or more embodiments, an outer ring 205 is provided on the last tubular joint 202. For example, the outer ring 205 extends radially outward from an outer surface 202*a* of the last tubular joint 202. The outer ring 205 may be made of the same material (e.g., steel or metal alloys) as the last tubular joint 202. For example, the outer ring 205 may be welded on the last tubular joint 202. The outer ring 205 increases an outer diameter OD3 of the last tubular joint 202 to a second outer diameter OD4. The second outer diameter OD4 corresponds to a maximum inner diameter of the quick release collar 100. For example, the second outer diameter OD4 may be equal to or less than the inner diameter (ID) of the quick release collar 100.

In some embodiments, the outer ring 205 may be positioned on the outer surface 202*a* a distance axially from a top end 202*b* and a bottom end 202*c* of the last tubular joint 202. For example, the outer ring 205 may be spaced closer to the top end 202*b* than the bottom end 202*c*. By having the outer ring 205 closer to the top end 202*b*, the top end 202*b* will be landed within the quick release collar 100. For example, the outer ring 205 may be welded approximate 5 feet below a landing joint coupling on the top end 202*b* of the last tubular joint 202.

In one or more embodiments, the outer ring 205 includes at least one hole 206. The at least one hole 206 may be used to allow fluids, such as mud and cement slurry, to flow through the outer ring 205. Additionally, the outer ring 205 includes at least one locking mechanism 215 to lock the last tubular joint 202 onto the quick release collar 100. The at least one locking mechanism 215 may be a rod extending downward from the outer ring 205. In some embodiments, the rod is serrated to prevent an upward movement of the last tubular joint 202 during cementing.

Figure 6:
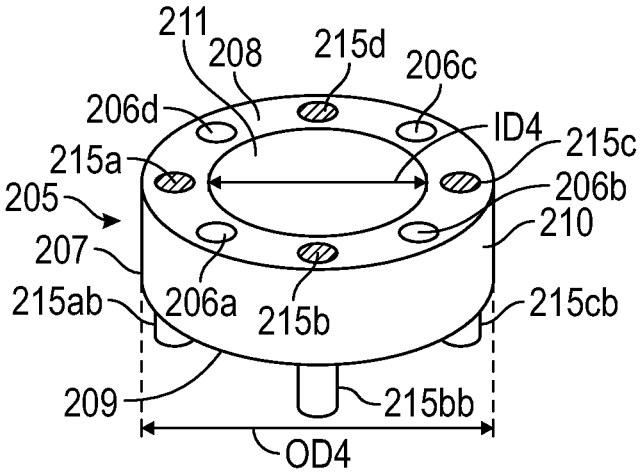
FIG. 6 illustrates a perspective view of an outer ring of the tubular string of FIG. 5 according to one or more embodiments of the present disclosure.

Now referring to FIG. 6, a perspective view of the outer ring 205 is illustrated. The outer ring 205 is defined by a ring 207 extending from a top surface 208 to a bottom surface 209. Additionally, the ring 207 includes an outer surface 210 shaped and sized to be flush against the inner surface 101*b* of the quick release collar 100. For example, the outer diameter OD4 of the ring 207 is equal to the inner diameter (ID) of the body 101 of the quick release collar 100. Further, the ring 207 includes an annular bore 211 delimited by the ring 207. The annular bore 211 defines an inner diameter ID4 of the outer ring 205 which corresponds to the outer diameter (OD3) of the last tubular joint 202.

In one or more embodiments, the bottom surface 209 is a landing surface to land on the inner ring 105 of the quick release collar 100. For example, the bottom surface 209 may be flat and perpendicular to the outer surface 202*a* of the last tubular joint 202 to allow flush engagement with the inner ring 105 of the quick release collar 100. It is further envisioned that a seal or pad may be provided on the bottom surface 209 to provide a resilient protective surface to land on the inner ring 105 of the quick release collar 100.

Still referring to FIG. 6, the outer ring 205 includes one or more holes 206*a*-206*d* extending through the ring 207 from the top surface 208 to the bottom surface 209. For example, four holes 206*a*-206*d* may be circumferentially positioned between the annular bore 211 and the outer surface 210. Additionally, the four holes 206*a*-206*d* may be evenly spaced from each other. For example, each hole 206*a*-206*h* may be radially spaced by 90 degrees in a circular pattern along the ring 207.

The holes 206*a*-206*d* are openings that extend axially through the ring 207. The holes 206*a*-206*d* allow fluid communication with an annulus formed by the outer surface 202*a* of the last tubular joint 202 and the inner surface 101*b* of the quick release collar 100. For example, holes 206*a*-206*d* align with the holes 106*a*-106*h* of the inner ring 105 of the quick release collar 100 to provide a fluid conduit. to pump fluids (e.g., mud or cement slurry) in and out of the annulus.

Additionally, the outer ring 205 includes one or more locking mechanisms 215*a*-215*d*. For example, four locking mechanisms 215*a*-215*d* may be circumferentially positioned between the annular bore 211 and the outer surface 210. Additionally, the locking mechanisms 215*a*-215*d* may be evenly spaced from each other. For example, each locking mechanism 215*a*-215*d* may be radially spaced by 90 degrees in a circular pattern along the ring 207.

In one or more embodiments, the one or more locking mechanisms 215*a*-215*d* include a rod 215*ab*-215*cb*. For example, the rod 215*ab*-215*cb* of each locking mechanisms 215*a*-215*d* extends downward from the bottom surface 209 of the outer ring 205. Each of the rods 215*ab*-215*cb* may be a corresponding shape (e.g., diamond, oval, circular, star, etc.) and size (i.e., diameter) to match the holes 106*a*-106*h* of the inner ring 105 of the quick release collar 100. For example, the rods 215*ab*-215-*cb* are inserted into the corresponding holes 106*a*-106*h* of the inner ring 105 of the quick release collar 100 to lock the last tubular joint 202 onto the quick release collar 100. Additionally, a length of each rod 215*ab*-215-*cb* may be longer than the length of the holes 106*a*-106*h* of the inner ring 105 such that each rod 215*ab*-215-*cb* extends out of the inner ring 105.

Figure 7A:
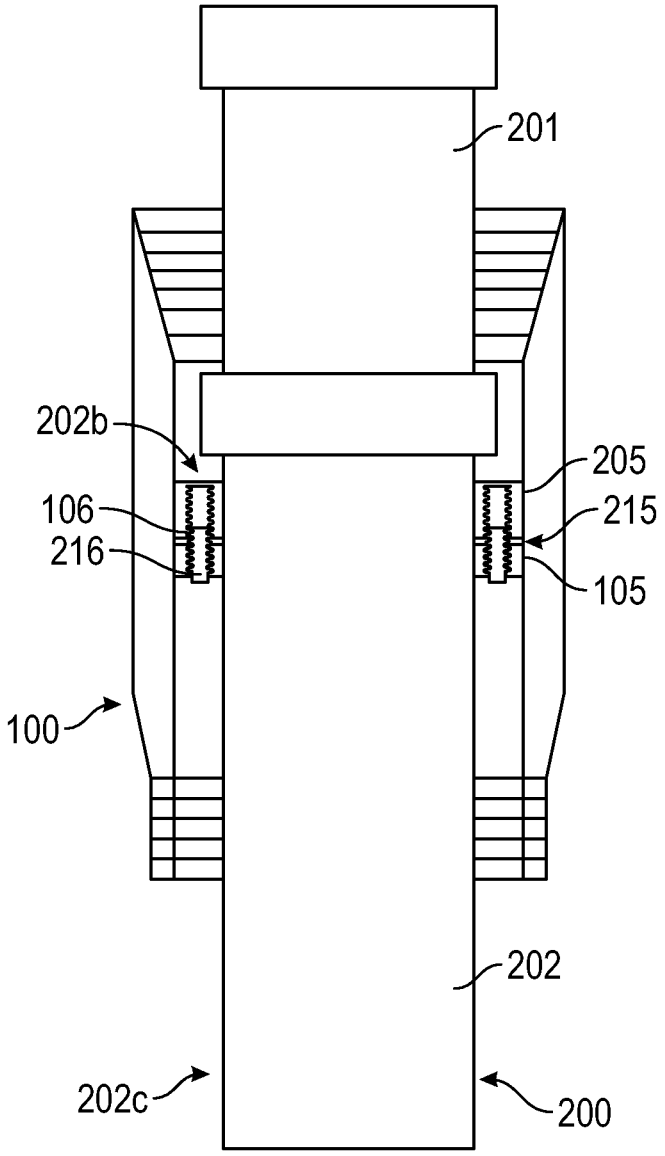
FIGS. 7A and 7B illustrate cross-sectional views of an assembled quick release collar according to one or more embodiments of the present disclosure.

Now referring to FIG. 7A, the tubular string 200 of FIG. 5 is shown landed onto the quick release collar 100 of the FIG. 3. The landing joint 201 lowers the last tubular joint 202 of the tubular string 200 into the quick release collar 100. The last tubular joint 202 is set within the quick release collar 100. For example, the outer ring 205 of the last tubular joint 202 lands on the internal ring 105 of the quick release collar 100. With the outer ring 205 on the internal ring 105, the bottom end 202*c* of the last tubular joint 202 will extend past the quick release collar 100 while the top end 20*b* of the last tubular joint 202 will be set within the quick release collar 100.

In one or more embodiments, as the outer ring 205 lands on the internal ring 105, the locking mechanism 215 of the outer ring 205 engages the holes 106 of the internal ring 105. The locking mechanism 215 couple the outer ring 205 to the internal ring 105. For example, a rod 216 of the locking mechanism 215 are inserted into the corresponding hole 106 of the internal ring 105. After tagging the inner ring 105 with the rods 216 of the outer ring 205, slight surface rotation may be applied to ensure that the rods 216 are latched inside the holes 106 of the internal ring 105. To confirm an integrity of the locking mechanism 215, a pulling force (e.g., approximate 5 KLb) may be applied to the last tubular joint 202 to ensure the rods 216 are locked into the holes 106. For example, the rods 216 may be serrated to lock within the holes 106. Additionally, the rod 216 extends through the internal ring 105 to lock the outer ring 205 on the internal ring 105.

Figure 7B:
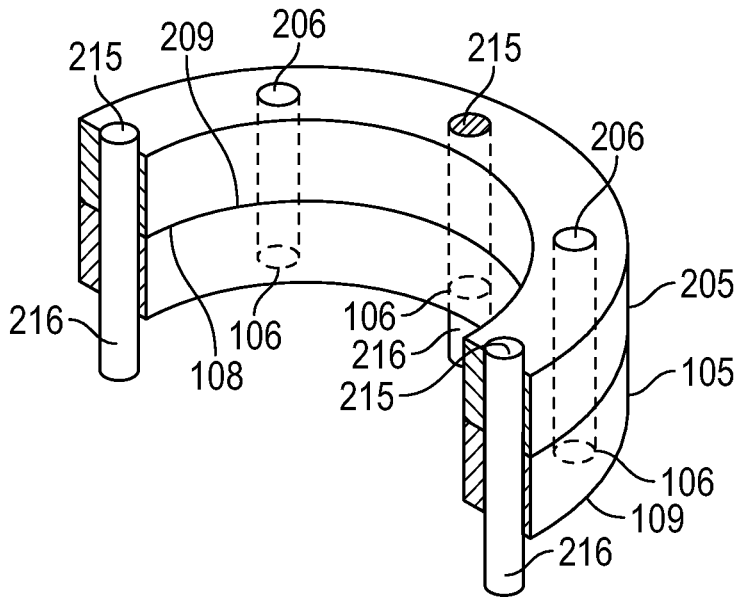

Now referring to FIG. 7B, a perspective cross-sectional view of the outer ring 205 landed on the internal ring 105 from FIG. 7A is illustrated. For simplicity purposes only, the outer ring 205 and the internal ring 105 are shown without the quick release collar 100 and the last tubular joint 202. As shown in FIG. 7B, the outer ring 205 and the internal ring 105 may have matching profiles to align with each other. Additionally, the outer ring 205 is flush against the internal ring 105. For example, the bottom surface 209 of the outer ring 205 lands directly onto the top surface 108 of the internal ring 105.

In one or more embodiments, the holes 206 of the outer ring 205 align with the holes 106 of the internal ring 105. By aligning the holes 106, 206 of each ring 105, 206, a conduit is formed by the rings 105, 206. This conduit allows a flow of fluids, such as mud or cement slurry, to flow through the rings 105, 206. For example, the fluids may be pushed up to a surface through the aligned holes 106, 206.

Additionally, the locking mechanisms 215 of the outer ring 205 engage with the holes 106 of the internal ring 105. For example, the rod 2016 of each locking mechanisms 215 is inserted into the holes 106 of the internal ring 105 not aligned with holes 206 of the outer ring 205. The rods 216 travel through the holes 106 of the internal ring 105 to extend below the bottom surface 109 of the internal ring 105. In some embodiments, each rod 216 may be a cylinder with a profile matching the shape of the holes 106 of the internal ring 105.

Figure 8A:
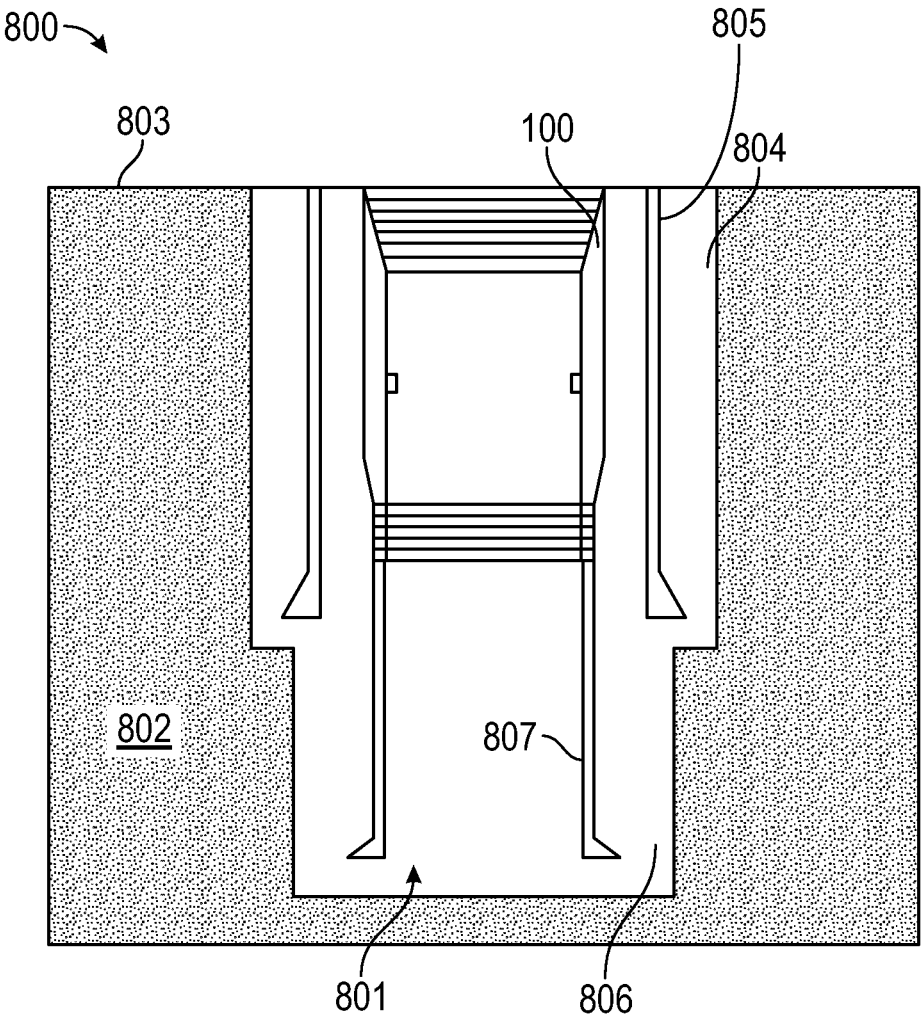
FIGS. 8A and 8B illustrate cross-sectional views of a system using a quick release collar according to one or more embodiments of the present disclosure.
Figure 8B:
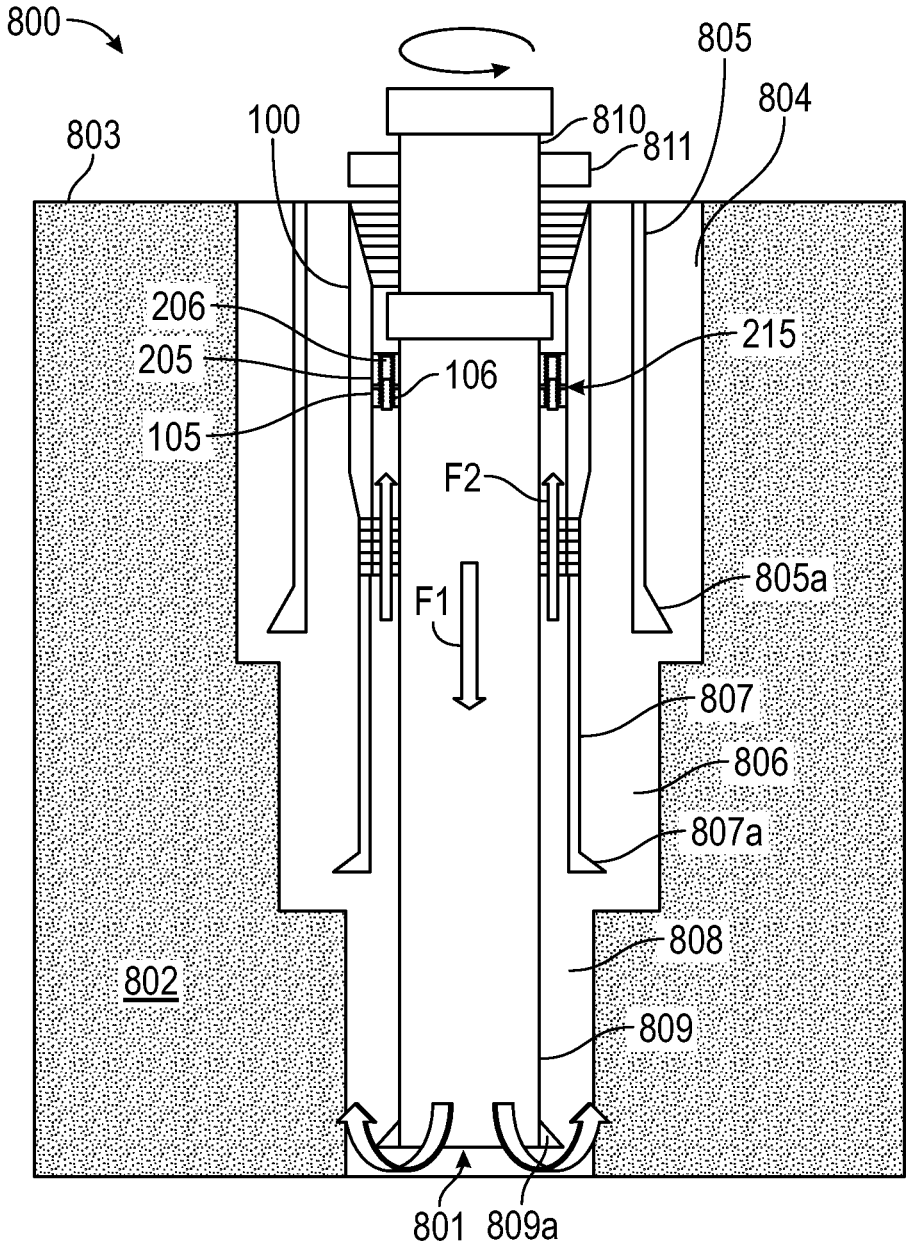

With respect to FIGS. 8A and 8B, in one or more embodiments, FIGS. 8A and 8B illustrated a system using the quick release collar 100 and the outer ring 205 as described above in tubular string cementing operations at a well site 800. In FIG. 8A, a wellbore 801 is formed by drilling into a formation 802 from a surface 803. Initially, a first section 804 of the wellbore 801 is drilled and a conductor tubular string 805 is lowered into and cemented against the first section 804. For example, the conductor tubular string 805 may extend 120 feet from the surface 803 into the formation 802 and have a 30" outer diameter to line the first section 804 of the wellbore 801. The conductor tubular string 805 includes a various tubulars connected end to end. Additionally, a cement slurry is pumped into the first section 804 of the wellbore 801 to fill an annulus between the conductor tubular string 805 and the wellbore 801. The cement slurry will then harden thereby cementing the conductor tubular string 805 to the first section 804 of the wellbore 801.

At a lower most end of the conductor tubular string 805, a float shoe or collar 805*a* may be provided. The float shoe 805*a* prevents reverse flow of the cement slurry from the annulus back into the conductor tubular string 805 or a flow of wellbore fluids into the conductor tubular string 805 as the conductor tubular string 805 is run into the wellbore 801. The float shoe 805*a* may also provide a guide to keep the conductor tubular string 805 centered in the wellbore 801 to minimize hitting rock ledges or washouts.

With the conductor tubular string 805 cemented in the first section 804 of the wellbore 801, a second section 806 of the wellbore 801 is drilled. A surface tubular string 807 is then lowered into the wellbore 801 to line the second section 806 of the wellbore 801. For example, the surface tubular string 807 may extend 600 feet from the surface 803 into the formation 802 and have a 24" (inch) outer diameter to line the second section 806 of the wellbore 801. The surface tubular string 807 includes a various tubulars connected end to end. At the top of the surface tubular string 807 approximate to the surface 803, the quick release collar 100. Additionally, a cement slurry is pumped into the second section 806 of the wellbore 801 to fill an annulus between the surface tubular string 807 and the wellbore 801. The cement slurry will then harden thereby cementing the surface tubular string 807 and the quick release collar 100 to the second section 806 of the wellbore 801.

Additionally, at a lower most end of the surface tubular string 807, a second float shoe or collar 807*a* may be provided. The second float shoe 807*a* prevents reverse flow of the cement slurry from the annulus back into the surface tubular string 807 or a flow of wellbore fluids into the surface tubular string 807 as the surface tubular string 807 is run into the wellbore 801. The float shoe 807*a* may also provide a guide to keep the surface tubular string 807 centered in the wellbore 801 to minimize hitting rock ledges or washouts.

Now referring to FIG. 8B, with the surface tubular string 807 and the quick release collar 100 cemented in the wellbore 801, a third section 808 of the wellbore 801 is drilled. Next, a second surface or intermediate tubular string 809 is then lowered into the wellbore 801 to line the second section 806 of the wellbore 801. For example, the second surface or intermediate tubular string 809 may extend 2000 feet from the surface 803 into the formation 802 and have a 18⅝" outer diameter to line the third section 808 of the wellbore 801. The second surface or intermediate tubular string 809 includes a various tubulars connected end to end.

Additionally, at a lower most end of the second surface or intermediate tubular string 809, a third float shoe or collar 809*a* may be provided. The third float shoe 809*a* prevents reverse flow of the cement slurry from the annulus back into the second surface or intermediate tubular string 809 or a flow of wellbore fluids into the second surface or intermediate tubular string 809 as the second surface or intermediate tubular string 809 is run into the wellbore 801. The float shoe 809*a* may also provide a guide to keep the second surface or intermediate tubular string 809 centered in the wellbore 801 to minimize hitting rock ledges or washouts.

In one or more embodiments, slips 811 provided at the surface 803 may be used suspend a weight of the second surface or intermediate tubular string 809 from a rig floor (not shown). For example, the slips 811 grip a landing joint 810 coupled to the second surface or intermediate tubular string 809. The slips 811 may be part of a rotary table or Kelly (not shown) of a rig above the wellbore 801.

As shown in FIG. 8B, the second surface or intermediate tubular string 809 includes the outer ring 205 to land on the internal ring 105 of the quick release collar 100. For example, once the second surface or intermediate tubular string 809 is fully lowered into the wellbore 801, the outer ring 205 lands on top of the internal ring 105. It is further envisioned that the weight of the second surface or intermediate tubular string 809 does not need to be slacked from the slips 811. Additionally, the locking mechanisms 215 of the outer ring 205 engage the holes 106 of the internal ring 105 to interlock the outer ring 205 and the internal ring 105 together. For example, the locking mechanisms 215 may be rods inserted into the holes 106. Furthermore, the hole 206 of the outer ring 205 align with the holes 106 of the of the internal ring 105 not engaged with the locking mechanisms 215. These aligned holes 106, 206 form a flow path through the interlocked rings 105, 205.

Once the locking mechanisms 215 is established in the internal ring 105 and the flow path is ensured between the interlocked rings 105, 205, a weight of the second surface or intermediate tubular string 809 is slacked on the slips 811 and the second surface or intermediate tubular string 809 is ready to be cemented. For example, during a cement job, a cement slurry is pumped down (see block arrow F1) the second surface or intermediate tubular string 809 and exits the third float shoe 809*a*. After exiting the third float shoe 809*a*, the cement slurry flow upwards (see curved block arrows) into an annulus between the second surface or intermediate tubular string 809 and the third section 808 of the wellbore 801. The cement slurry will continue to flow upwards (see block arrows F2) through the flow path formed between the aligned holes 106, 206 of the interlocked rings 105, 205. From this flow path, the element slurry and other fluids (e.g., well fluids and mud) are returned to the surface 803. At the surface 803, the element slurry and other fluids may be disposed in a mud pit (not shown).

Once the cement job is executed, the landing joint 810 may be removed. For example, the slips 811 may rotate (see curved arrow) the landing joint 810 in a left-hand direction to hang the second surface or intermediate tubular string 809 on the internal ring 105. Once the landing joint 810 is removed, various surface equipment (e.g., wellhead or diverter) may be flushed to remove any residual cement slurry or fluids between the interlocking rings 105, 205. By having the outer ring 205 of the second surface or intermediate tubular string 809 interlocked with internal ring 105 of the quick release collar 100, the wait on cement (WOC) may be eliminated. WOC refers to suspending drilling operations while allowing cement slurries to solidify, harden and develop compressive strength. For example, a bottom hole assembly (BHA) for drilling the next section of the wellbore 801 may be prepared and lowered into the second surface or intermediate tubular string 809 without WOC due to the interlocking rings 105, 205. It is further envisioned that additional quick release collars may be used for any tubular string (e.g., additional intermediate tubular strings or a production tubular string) within the wellbore 801.

Figure 9:
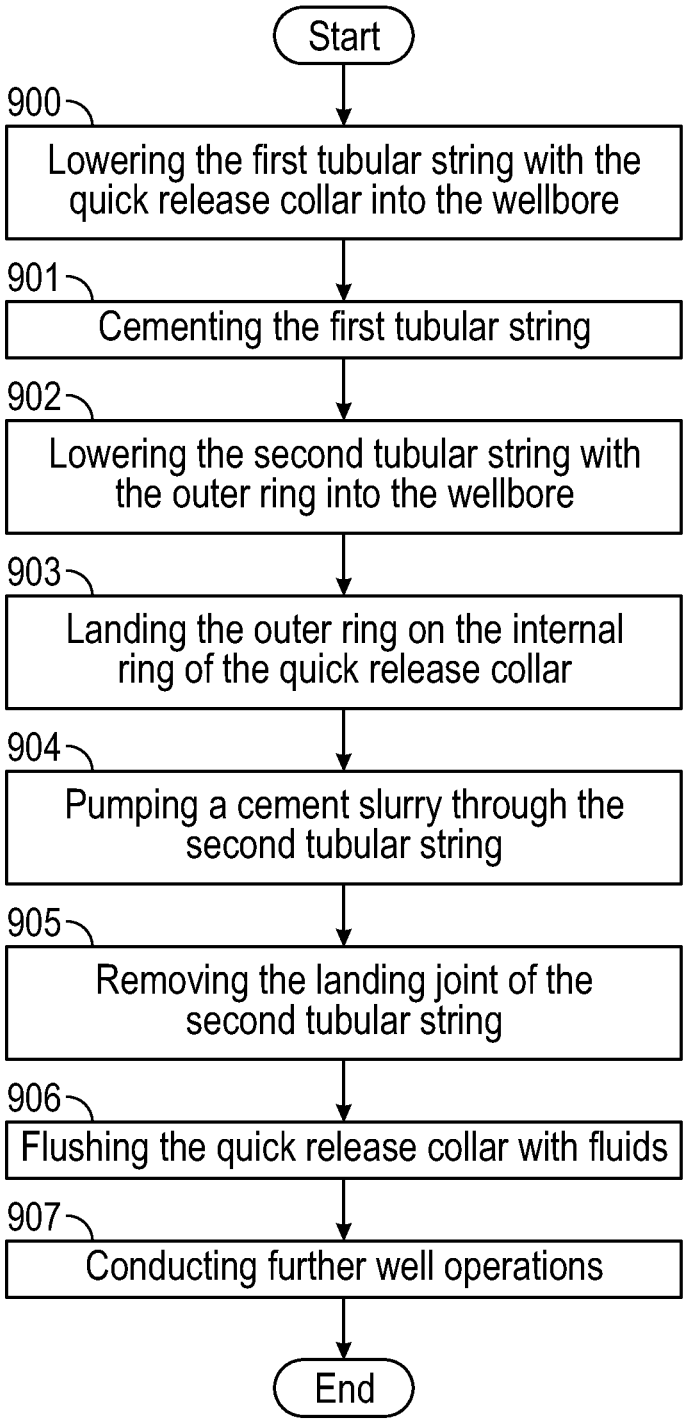
FIG. 9 illustrates a flowchart for utilization of the quick release collar according to one or more embodiments of the present disclosure.

Referring to FIG. 9 illustrates a flowchart for the utilization of the quick release collar 100 to conduct wellbore operations. One or more steps in FIG. 9 may be performed by one or more components (for example, the computing system coupled to a controller in communication with the quick release collar 100) as described in FIGS. 3-8B. For example, a non-transitory computer readable medium may store instructions on a memory coupled to a processor such that the instructions include functionality for operating the quick release collar 100. While the various steps in FIG. 9 are presented and described sequentially, one of ordinary skill in the art will appreciate that some or all of the steps may be executed in different orders, may be combined or omitted, and some or all of the steps may be executed in parallel. Furthermore, the steps may be performed actively or passively.

In step 900, a first tubular string with the quick release collar is lowered into the wellbore. The quick release collar is coupled to a top of the first tubular string. By coupled the quick release collar to the top of the first tubular string, the quick release collar is the upper most part of the first tubular string within the wellbore. The quick release collar may be approximate to the surface such that surface equipment may be coupled to the quick release collar.

In step 901, with the first tubular string in the wellbore, the first tubular string is cemented. For example, a first cementing is performed by circulating a first cement slurry through a first float shoe at a bottom end of the first tubular string and into an annulus between the first tubular string and the wellbore. The first cement slurry is pumped down through the first tubular string. The first cement slurry is then hardened to cement the first tubular string to the wellbore. Additionally, the quick release collar is also cemented to the wellbore.

In step 902, a second tubular string with the outer ring is lowered into the wellbore. For example, the second tubular string is inserted into the first tubular string and lowered down the wellbore. Additionally, the second tubular string runs down a longer depth into the wellbore then the first tubular string.

In step 903, with the second tubular string in the wellbore, the outer ring of the second tubular string is landed on the internal ring of the quick release collar. For example, the bottom surface of the outer ring sits on top of the top surface of the internal ring. Additionally, the locking mechanisms of the outer ring engages with holes of the internal ring. For example, the rod of each locking mechanism is inserted into a corresponding hole of the internal ring to interlock the outer ring and the internal ring together. Additionally, serrations of the rod may be locked within the corresponding hole. Further, the holes of the outer ring are aligned with corresponding holes of the internal ring to form a flow path through the interlocking rings. In some embodiments, when the outer ring lands the internal ring, slips at the rig floor may suspend a weight of the second tubular string.

In step 904, with the rings interlocked, the cement slurry is pumped through the second tubular string. For example, a second cementing is performed by circulating a second cement slurry through a second float shoe at a bottom end of the second tubular string and into an annulus between the second tubular string and the wellbore. The second cement slurry is pumped down the bore of the second tubular string. The second cement slurry may be pumped for a predetermined time to cement the second tubular string below the interlocking rings. For example, the second cement slurry flows up the annulus and any excess amount of the second cement slurry and other fluids are pushed through the flow path in the interlocking rings. From the flow path in the interlocking rings, the excess amount of the second cement slurry and other fluids are transported to the surface. At the surface the excess amount of the second cement slurry and other fluids may be transported to a mud pit.

In step 905, with the cement slurry in place, the landing joint of the second tubular string is removed. For example, slips at the rig floor rotate the landing joint to disconnect from the second tubular string. Additionally, the top connection of the landing joint may be a lefthand connection such that a lefthand turn releases the landing joint from the second tubular string. Once the landing joint is removed, the landing joint may be laid down on the rig floor for future use.

In step 906, the quick release collar is flushed with fluids. For example, the fluids (e.g., water) may be pumped down the annulus between the second tubular string and the quick release collar above the interlocking rings. The fluids will flush any excess fluids (e.g., cement slurry or debris) between the interlocking rings. In some embodiments, a diverter kill line or choke line at the surface may be used to pump the fluids down to the flush the quick release collar.

In step 907, further well operations are conducted after the cement slurry is in place for the second tubular string. For example, the BHA for drilling the next section of the wellbore may be prepared and lowered into the second tubular string without WOC. It is further envisioned that steps 900-907 may be repeated to install additional tubular strings within the wellbore.

In addition to the benefits described, the quick release collar disclosed herein may improve an overall efficiency and performance of cementing operation in a wellbore while reducing cost and shortening well delivery time. Additionally, the quick release collar tool may reduce risks associated with lifting a diverter and hazards associated with cutting and welding casing, improving flow circulation of fluids (e.g., cement slurry), and uniform and circumferential cement placement in an annulus. Further, the quick release collar may provide further advantages such as reducing operational steps and level of difficulty in conventional methods.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed is:

1. A system, comprising:

a first tubular string within a wellbore, wherein the first tubular string comprises a plurality of first tubular joints joined end-to-end;

a collar coupled to a top of the first tubular string, the collar comprising:

a body extending from a first end to a second end, wherein the body comprises:

an internal ring extending radially inward from an inner surface of the body, wherein the internal ring comprises at least two holes extending through a top surface of the internal ring to a bottom surface of the internal ring; and a second tubular string within the wellbore, wherein the second tubular string comprises a plurality of second tubular joints joined end-to-end, wherein the second tubular string extends through the first tubular string, wherein an outer ring of the second tubular string lands on the internal ring, and wherein a bottom surface of the outer ring is flush against the top surface of the internal ring.

2. The system of claim 1, wherein the outer ring further comprises:

at least one hole extending through a top surface of the outer ring to a bottom surface of the outer ring; and at least one locking mechanism to engage a second hole of the at least two holes of the internal ring.

3. The system of claim 2, wherein the at least one locking mechanism is a rod extending outwardly from the bottom surface of the outer ring.

4. The system of claim 3, wherein the internal ring comprises eight holes of the at least two holes, wherein four of the eight holes are configured to receive a corresponding rod of four of the at least one locking mechanism.

5. The system of claim 3, wherein the rod is serrated.

6. The system of claim 2, wherein the at least one hole of the outer ring aligns with a first hole of the at least two holes of the internal ring to form a flow path through the internal ring and the outer ring.

7. The system of claim 6, wherein the internal ring comprises eight holes of the at least two holes, wherein four of the eight holes are configured to align with four holes of the at least one hole of the outer ring.

8. The system of claim 1, wherein a landing joint of the second tubular string comprises a lefthand connection end.

9. The system of claim 1, wherein the outer ring extends radially outward from an outer surface of a top tubular joint of the second tubular string.

10. A method, comprising:

lowering a first tubular string into a wellbore, wherein a collar is coupled to a top end of the first tubular string;

performing a first cementing by circulating a first cement slurry through a first float shoe at a bottom end of the first tubular string and into a first annulus between the first tubular string and the wellbore;

lowering a second tubular string into the wellbore;

landing an outer ring of the second tubular string on an internal ring of the collar, wherein landing the outer ring on the internal ring comprises:

sitting a bottom surface of the outer ring flush against a top surface of the internal ring;

engaging a locking mechanism of the outer ring with a first hole of the internal ring; and aligning holes of the outer ring with a second hole of the internal ring; and performing a second cementing by circulating a second cement slurry through a second float shoe at a bottom end of the second tubular string and into a second annulus between the second tubular string and the wellbore.

11. The method of claim 10, wherein engaging the locking mechanism with the first hole comprises:

inserting a rod of the locking mechanism into the first hole.

12. The method of claim 11, further comprising:

locking serrations of the rod within the first hole.

13. The method of claim 10, wherein landing the outer ring on the internal ring further comprises:

forming a flow path through the outer ring and the internal ring with the aligned holes.

14. The method of claim 13, further comprising flushing an excess cement slurry between the outer ring and the internal ring via the flow path.

15. The method of claim 10, further comprising removing a landing joint of the second tubular string with a lefthand turn.

16. The method of claim 10, further comprising conducting wellbore operations before waiting on the second cement slurry to harden.

17. The method of claim 10, further comprising suspending a weight of the second tubular string with slips on a rig floor.

* * * * *